United States Patent [19]

Mancinelli

[11] 4,217,816

[45] Aug. 19, 1980

[54] VENTILATING FANS

[76] Inventor: Vittorio Mancinelli, Via A. Guglieri 23, Borgomaro (Imperia), Italy

[21] Appl. No.: 973,775

[22] Filed: Dec. 27, 1978

[51] Int. Cl.[2] ..... F04D 25/08; F04D 25/14

[52] U.S. Cl. ..... 98/116; 98/40 V; 98/94 AC; 415/125

[58] Field of Search ..... 98/116, 94 AC, 40 V; 415/125

[56] References Cited

U.S. PATENT DOCUMENTS

| | | | |
|---|---|---|---|
| 2,196,308 | 4/1940 | Johnston | 98/116 |
| 3,004,485 | 10/1961 | Bristol | 98/116 |
| 3,064,548 | 11/1962 | Field | 98/116 |
| 4,007,673 | 2/1977 | Zaloga | 98/116 |

*Primary Examiner*—Ronald C. Capossela

*Attorney, Agent, or Firm*—Sughrue, Rothwell, Mion, Zinn and Macpeak

[57] ABSTRACT

The ventilating fan is comprised of a centrifugal governor which is driven by the fan impeller for causing a plurality of simultaneously operable pivotable louvers, which are supported by the fan casing, to move to their open position during fan operation. When the fan impeller is stopped, a spring which is interposed between the louvers and the casing caused the louvers to return to their closed position.

4 Claims, 6 Drawing Figures

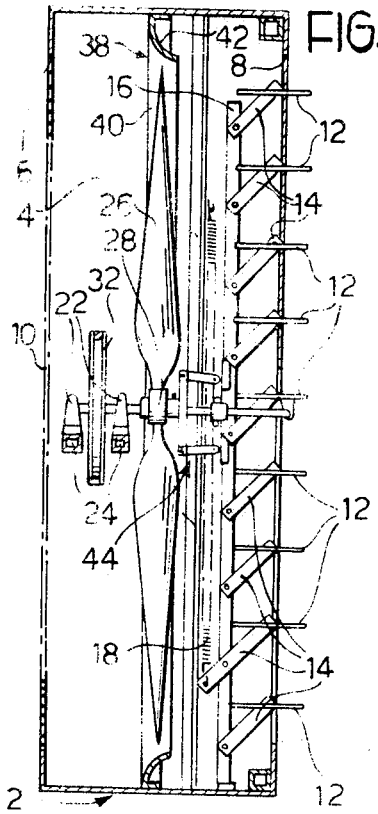
FIG. 3
FIG 2
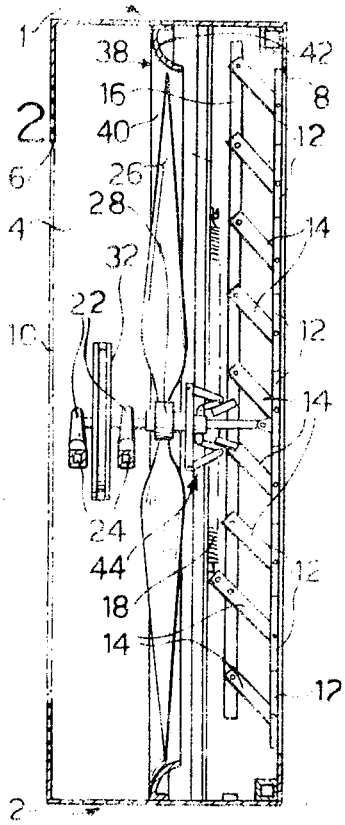
FIG. 5
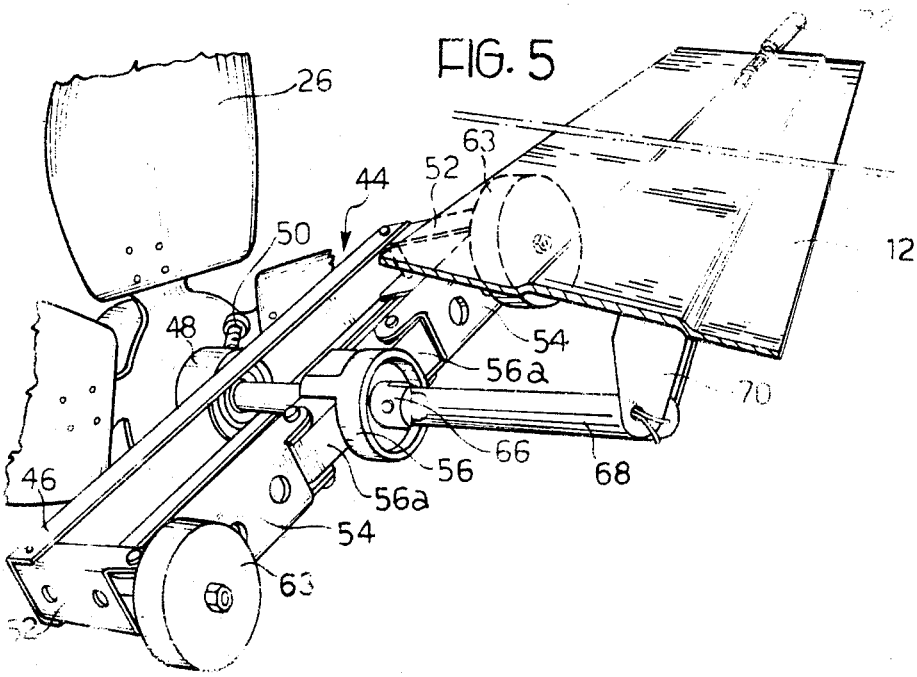

VENTILATING FANS

BACKGROUND OF THE INVENTION

1. Field of the Invention

The present invention relates to ventilating fans and more particularly to tubed axial fans.

2. Prior Art

Tubed axial ventilating fans are often provided with a plurality of simultaneously operable pivotable louvers supported by the fan casing and movable between a closed position, to which they are biassed by a spring which is interposed between the louvers and the casing, and an open position in which they must be held during fan operation. Usually, the louvers are manually or electrically operated.

SUMMARY OF THE INVENTION

It is an object of the invention to provide a tubed axial ventilating fan with a mechanical device adapted to be driven by the fan impeller so as to permit automatic operation of said louvers.

It is another object of the invention to provide a tubed axial ventilating fan of simple construction and economical fabrication.

The foregoing objects are achieved according to the invention by providing a tubed axial ventilating fan comprising a casing which defines an air flow passage having an air flow inlet and an air flow outlet, an electrically driven fan impeller rotatably mounted within said casing, a plurality of simultaneously operable pivotable louvers which are disposed in said air flow outlet, spring means between said louvers and said casing for biasing said louvers to a closed condition, and centrifugal governor means which are driven by said fan impeller for causing said louvers to displace to an open condition, against the bias of said spring means, during fan operation.

The ventilating fan according to the invention is particularly adapted for ventilation of rooms used for industrial, agricultural or zootechnic purposes, like store houses, green houses and cow houses, in which it is necessary to keep the inner environment isolated from the outer environment when ventilation is not requested.

Other objects, features and advantages of the present invention will be apparent from the following more particular description of the preferred embodiment of the invention as illustrated in the accompanying drawings.

BRIEF DESCRIPTION OF THE DRAWINGS

FIGS. 2, 3 are sections taken on the line II—II of FIG. 1, showing two different operative conditions of the ventilating fan of FIG. 1, FIG. 5 is a perspective view which shows a detail of FIG. 3 in enlarged scale.

DETAILED DESCRIPTION OF THE INVENTION

Figure 1:
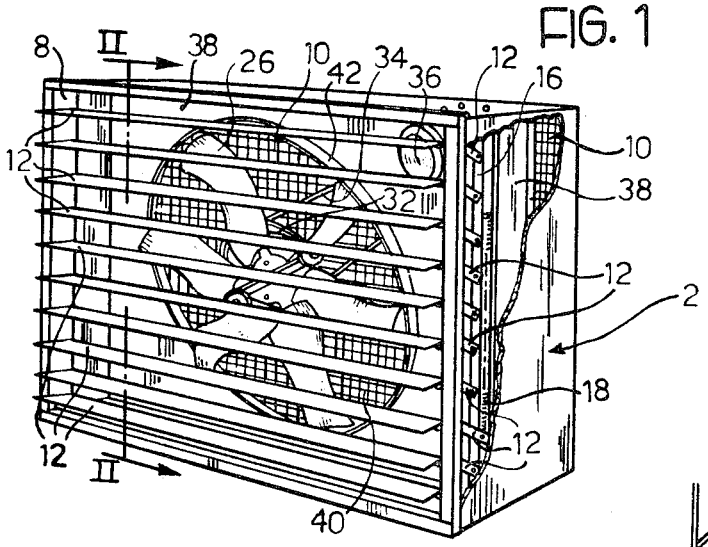
FIG. 1 is a perspective view of a ventilating fan according to the present invention.

The tubed axial ventilating fan as shown in FIGS. 1,2 and 3 is comprised of a casing 2 which is in form of a hollow parallelepiped body defining a passage 4 for the air flow which is to be fed to the ventilating fan. Two opposite walls of the casing 2 have apertures 6,8 which respectively provide an inlet and an outlet for the air flow. The air flow inlet 6 is provided with a metal wire net 10 which prevents foreign bodies from entering into the casing 2. The air flow outlet 8 is provided with a plurality of simultaneously operable pivotable louvers 12. Each louver is pivotally supported by two opposite walls of a casing 2 and is also provided at one of its ends with a connecting rod 15 which has an end fixed to the louver and the other end pivotally connected to a vertical bar 16. Thus, all the louvers 12 are interconnected by means of the bar 16, so that it is possible to move only one of the louvers for causing a movement of all the louvers 12. One of the connecting rods 14 have an elongated portion 14*a* which is connected to one end of the spring 18. The other end of the spring 18 is fixed to a wall of the casing 2 so that the bar 16 is biassed upwardly and the louvers 12 are held in a closed conditions.

Figure 6:
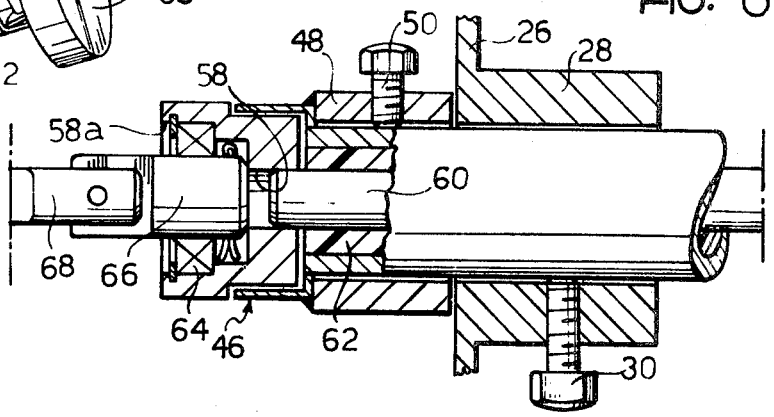
FIG. 6 is a view in section taken on the line VI—VI of FIG. 4.

A hollow shaft 20 is rotatably supported by two bearings 22 which are fixed to two parallel hollow beams 24. Each beam 24 has a square cross section and is supported by two opposite walls of the casing 2. A fan impeller 26 is mounted on the hollow shaft 20. The impeller 26 has a hub 28 (see also FIG. 6) which can be fixed to the shaft 20 by means of a screw 30. A pulley 32 is also fixed to the shaft 20. The pulley 32 is connected, by means of a belt 34, to an electric motor 36 which is mounted within the casing 2 (see FIG. 1). The casing 2 is also provided with an inner wall 38 which is disposed in the same plane in which the fan impeller 26 lies. The inner wall 38 has a circular aperture 40 which surrounds the impeller 26. The aperture 40 has an edge 42 which is designed to improve the pressure characteristics of the fan.

A centrifugal governor 44 is mounted on the end of the shaft 20 which is opposite to the pulley 32. The governor 44 is comprised of a channel-shaped bar 46 (see also FIGS. 4,5 and 6) which is provided on its central portion with a hub 48 the axis of which is orthogonal to the bar 46. the hub 48 is fixed to the shaft 20 by means of a screw 50. Two arms 52 are pivotally connected to the ends of the bar 46. The ends of the arm 52 which are opposite to the bar 46 are linked by means of two pivoted rods 54 to two side portions 56*a* of a reciprocable element 56. The element 56 is provided with a central hole 58 in which a guide rod 60 is forced. The guide rod 60 is slidably mounted within the hollow shaft 20, so that the element 56 can reciprocate in a direction which is coincident with the axis of the shaft 20. An antifriction bush 62 is interposed between the shaft 20 and the rod 60. Two weights 63 are fixed to the ends of the pivoted rods 54 which are opposite to the reciprocable element 56. The central hole 58 of the element 56 has an enlarged portion 58*a* in which a roller bearing 64 is mounted, the roller bearing 64 supporting a pin 66 which can therefore follow the reciprocating movement of the element 56 without being caused to rotate by the governor 44.

Figure 4:
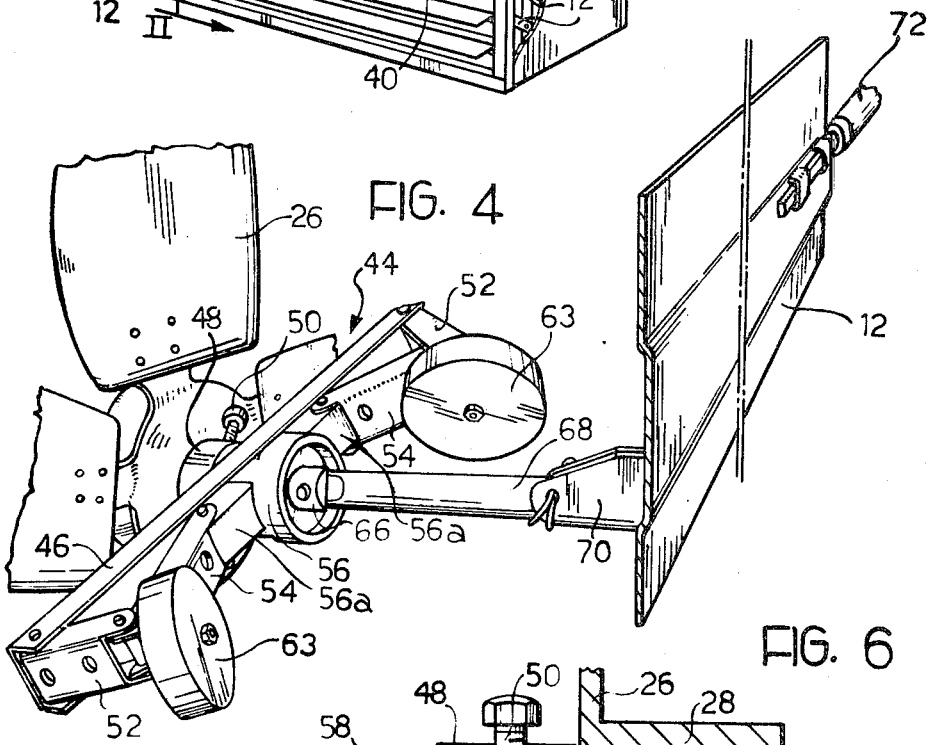
FIG. 4 is a perspective view which shows a detail of FIG. 2 in enlarged scale.

An actuating rod 68 is pivotally connected to the pin 66 at one of its ends and to a projection 70 of one of the louvers 12 at the other end. In FIGS. 4,5 the reference number 72 indicates a support pin which is fixed to each end of each louver for the pivoted connection of the louvers to the casing 2.

The reciprocable element 56 is movable to and from between a rest position (see FIGS. 2,4,6), in which it lies against the bar 46 and the weights 63 are closer to the axis of the snaft 20, and an operative position (see FIGS. 3,5) in which the reciprocable element 56 is spaced apart from the bar 46 and the pivoted rod 68 and the side portions 56*a* of the element 56 are aligned, the distance between the weights 63 being substantially equal to the length of the bar 46. Thus, when the reciprocable element is in its operative position, the bar 46, the arms 52, the rods 54 and the element 56 are aligned, the distance between the weights 63 being substantially equal to the length of the bar 46. Thus, when the reciprocable element is in its operative position, the bar 46, the arms 52, the rods 54 and the element 56 are disposed so as to form a rectangle.

When the reciprocable element 56 is in its rest position, the louvers 12 are closed. Since the spring 18 holds the louvers in their closed position, the reciprocable element 56 is always biassed towards the bar 46. When the reciprocable element 56 is in its operative position, the actuating rod 68 holds the louvers 12 in their open position against the bias of a spring 18.

As soon as the electric motor 36 is started, the rotational movement transmitted to the impeller 26 by means of the belt 34 and the pulley 32, causes the centrifugal governor 44 to rotate. The centrifugal forces acting against the weights 63 cause the reciprocable element 56 to move from its rest position (FIG. 4) to its operative position (FIG. 5). Thus, the louvers 12 are compelled to pivot towards their open position. When the motor 36 is stopped, the spring 18 causes the louvers 12 to move towards their closed position so that the reciprocable element 56 returns to its rest position.

While the invention has been particularly shown and described with reference to a preferred embodiment thereof, it will be understood by those skilled in the art that various changes in form and details may be made therein without departing from the spirit and scope of the invention.

What is claimed is:

1. A tubed axial ventilating fan, comprising a casing which defines an air flow passage having an air flow inlet and an air flow outlet, an electrically driven fan impeller, said fan impeller being carried by an impeller shaft which is rotatably mounted within said casing, a plurality of simultaneously operable pivotable louvers which are disposed in said air flow outlet, spring means between said louvers and said casing for biasing said louvers to a closed condition, and centrifugal governor means which are driven by said fan impeller for causing said louvers to displace to an open condition, against the bias of said spring means, during fan operation, said centrifugal governor means comprising a governor body mounted on said shaft, at least two weights pivotally connected to said body and symmetrically disposed with respect to said shaft, a reciprocable element which is reciprocally mounted on said shaft and connected to said weights by means of pivoted elements and an actuating member rotatably mounted on said reciprocable element and connected to one of said louvers for causing all louvers to operate.

2. A tubed axial ventilating fan as set forth in claim 1, wherein said impeller shaft is hollow, said reciprocable element being provided with a guide rod which is reciprocably mounted within said shaft, an anti-friction bush being interposed between said guide rod and said shaft.

3. A tubed axial ventilating fan as set forth in claim 2, wherein a roller bearing is interposed between said reciprocable element and said actuating rod.

4. A tubed axial ventilating fan as set forth in claim 2, wherein said governor body is in form of a bar having a central portion provided with a hub which has an axis orthogonal to said bar, said hub being mounted on said shaft and provided with means for securing said hub to said shaft, said reciprocable element being movable between a rest position, in which said element lies against said bar and said louvers are in their closed condition, and an operative position in which said reciprocable element is spaced apart from said bar so as to cause said actuating rod to hold said louvers in their open condition, said bar, said arms and said pivoted rods being disposed so as to define a rectangle when said reciprocable element is in its operative position, two opposite sides of said rectangle being defined by said arms, another side being defined by said bar and the side opposite thereto being defined by said pivoted rods and said reciprocable element.

* * * * *